US011839301B2

(12) United States Patent
Jørgensen

(10) Patent No.: US 11,839,301 B2
(45) **Date of Patent: *Dec. 12, 2023**

(54) FRAME FOR A TABLE

(71) Applicant: LINAK A/S, Nordborg (DK)

(72) Inventor: Casper Jørgensen, Sydals (DK)

(73) Assignee: Linak A/S, Nordborg (DK)

( * ) Notice: Subject to any disclaimer, the term of this patent is extended or adjusted under 35 U.S.C. 154(b) by 0 days.

This patent is subject to a terminal disclaimer.

(21) Appl. No.: 17/828,403

(22) Filed: May 31, 2022

(65) Prior Publication Data

US 2022/0287452 A1 Sep. 15, 2022

Related U.S. Application Data

(63) Continuation of application No. 16/977,344, filed as application No. PCT/DK2019/000094 on Mar. 13, 2019, now Pat. No. 11,357,320.

(30) Foreign Application Priority Data

Mar. 14, 2018 (DK) ..... PA 2018 00117

(51) Int. Cl.
*A47B 9/20* (2006.01)

(52) U.S. Cl.
CPC ..... *A47B 9/20* (2013.01); *A47B 2200/0051* (2013.01); *A47B 2200/0057* (2013.01)

(58) Field of Classification Search
CPC ..... A47B 9/20; A47B 9/04; A47B 2200/0051; A47B 2200/0057
USPC .... 108/147, 144.11, 147.19, 147.22, 159.11, 108/157.1; 248/188.1, 188.3, 188.5
See application file for complete search history.

(56) References Cited

U.S. PATENT DOCUMENTS

| | | | |
|---|---|---|---|
| 6,182,583 | B1 | 2/2001 | Larson |
| 6,509,705 | B2 | 1/2003 | Bastholm et al. |
| 8,276,526 | B2 | 10/2012 | Verweij |
| 8,640,562 | B2 | 2/2014 | Pettersson |
| 8,752,488 | B2 | 6/2014 | Moller |
| 8,967,054 | B2 | 3/2015 | Henriott et al. |
| 9,038,549 | B1 | 5/2015 | Zebarjad |
| 10,349,737 | B2 | 7/2019 | Keller et al. |

(Continued)

FOREIGN PATENT DOCUMENTS

| | | | |
|---|---|---|---|
| CH | 710641 | A1 | 7/2019 |
| DE | 30 49 357 | A1 | 7/1982 |

(Continued)

*Primary Examiner* — Jose V Chen
(74) *Attorney, Agent, or Firm* — Dykema Gossett PLLC

(57) ABSTRACT

A frame for sit-stand-tables comprising a longitudinal member, two height-adjustable legs with at least two telescopic profiles, namely an outer and an inner profile, and with a driving mechanism, driven by a motor unit, comprising an electric motor and a gear. According to the invention the motor unit is arranged in the longitudinal member and connected to the driving mechanism in the height-adjustable legs. Thus, a frame with a simplified construction is achieved. The construction of the legs can be simplified and at the same time the dimensions can be reduced, as it is not necessary to take the building-in of a motor into the legs into consideration. As both legs are driven by a joint motor unit, the electric control can also be simplified as it will not have to drive the two legs synchronously.

19 Claims, 19 Drawing Sheets

(56) References Cited

U.S. PATENT DOCUMENTS

| | | | | |
|---|---|---|---|---|
| 10,405,646 | B2 | 9/2019 | Tseng et al. | |
| 10,791,826 | B2 | 10/2020 | Crowe et al. | |
| 11,357,320 | B2 * | 6/2022 | Jørgensen | A47B 21/02 |
| 2002/0046684 | A1 | 4/2002 | Lin | |
| 2008/0178779 | A1 | 7/2008 | Agee | |
| 2011/0168064 | A1 | 7/2011 | Jahnsen et al. | |
| 2015/0136000 | A1 | 5/2015 | Höltschi et al. | |
| 2016/0113391 | A1 | 4/2016 | Wang | |
| 2017/0071332 | A1 | 3/2017 | Herring et al. | |
| 2017/0303679 | A1 | 10/2017 | Tseng | |
| 2018/0110325 | A1 | 4/2018 | Oberndörfer | |
| 2018/0242728 | A1 | 8/2018 | Hansen et al. | |
| 2018/0368569 | A1 | 12/2018 | Laing | |
| 2019/0029413 | A1 | 1/2019 | Patton et al. | |
| 2019/0069669 | A1 | 3/2019 | Hall et al. | |
| 2019/0261778 | A1 | 8/2019 | Lukas et al. | |
| 2020/0154881 | A1 | 5/2020 | Applegate et al. | |

FOREIGN PATENT DOCUMENTS

| | | | |
|---|---|---|---|
| DE | 202016002581 | U1 | 5/2016 |
| EP | 2926688 | A1 | 10/2015 |
| WO | 03/003876 | A1 | 1/2003 |
| WO | 2004/100632 | A1 | 11/2004 |
| WO | 2015180723 | A1 | 12/2015 |
| WO | 2015180724 | A1 | 12/2015 |
| WO | 2015180725 | A1 | 12/2015 |
| WO | 2018093324 | A1 | 5/2018 |

* cited by examiner

FRAME FOR A TABLE

PRIORITY

This application is a continuation of U.S. patent application Ser. No. 16/977,344, filed Sep. 1, 2020 (the '344 application), to be issued as U.S. Pat. No. 11,357,320 on Jun. 14, 2022, the '344 application being a national stage filing based upon international application no. PCT/DK2019/000094, filed Mar. 13, 2019 (the '094 application), and published in English on Sep. 19, 2019 under international publication no. WO 2019/174686 A2, which claims priority to Denmark (DK) patent application no. PA 2018 00117, filed March 2018 (the '117 application). The '344 application, the '094 application and the '117 application are all hereby incorporated by reference as though fully set forth herein.

BACKGROUND a. Technical Field

The present invention relates to a frame for sit-stand-tables comprising a cross member, two height-adjustable legs with at least two telescopic profiles, namely an outer and inner profile and having a drive mechanism driven by a motor unit comprising an electric motor and a gear. The invention further relates to a table having such a frame and a method for assembly of the table.

b. Background Art

Lifting columns comprising a telescopic guide and a box-shaped housing for height-adjustable tables where the telescopic guide appears as a table leg were developed in the late 1990s. The box-shaped housing, which is usually rectangular, comprises an electric motor, a transmission and various electronics. An example of such a lifting column is disclosed in FIG. 1 of WO 2004/100632 A1 to LINAK A/S. A different type of lifting column is described in WO 03/003876 A1 to LINAK A/S, where the entire drive unit, i.e. electric motor, transmission and various electronics are integrated in the telescopic guide.

A frame for a height-adjustable table, which comprises an upper frame, which typically comprises two longitudinal members and two cross members, at least one lifting column and at least one foot. The lifting column can, as described above, be constructed with or without a box-shaped housing at the upper end. The longitudinal members are usually constructed as through-going tube profiles, located in parallel with a mutual distance corresponding to the width of the box-shaped housing. At each end of the longitudinal members a cross member is secured. The longitudinal members and the cross members are usually welded together or have to be assembled with screws. A lifting column is mounted at each end by placing the box-shaped housing between the longitudinal members with an end against the respective cross member. The lifting column is secured by means of screws through the two longitudinal members and through the cross member into the box-shaped housing. An example of such a table is shown in FIG. 1 of U.S. Pat. No. 6,509,705 B2 to LINAK A/S. Assembly of the frame is troublesome and time consuming. This is due to the parts of the frame being relatively large and heavy. Furthermore, the assembly of the frame requires a number of screw operations, which requires that the individual parts are placed correctly relative to each other.

DE 20 2016 002 581 U1 to Kessebohmer discloses a table with height-adjustable legs having a built-in motor—this type of leg is also known as in-line lifting columns. To the upper end of the leg a plate is secured, which extends a distance over the end of the leg. At one end, the plate is equipped with a protruding cam in each side intended for insertion into a slit in the upper frame. At the opposite end, the plate is in either side equipped with a slanting portion intended for engagement with a spring-loaded pawl mounted in the upper frame and in its longitudinal direction. When mounting, the leg is held in an inclined position by which the cams can be inserted into the respective slits. When the cams are in place in the slits, the leg is turned into a vertical position during which the slanting portion engages the spring-loaded pawl and presses this away from the slanting portions, and when the pawls during the raising of the leg are free of the slanting portion and reaches the area below the slanting portions, the spring loaded pawls will snap back over the slanting portions and thus prevent the slanting portions from moving backwards, thus retaining the leg in the raised position. This mounting is not straightforward and moreover the joint is subject to a great deal of play due to the "hinging" in one side which can make the table appear unstable.

US 2017/0303679 A1 to Timotion discloses a frame comprising a longitudinal member with a height-adjustable leg at each end, which through the respective drive shafts are driven by a motor unit located in the longitudinal member. Here, it has, however, been necessary to utilize a special coupling for connecting the legs in order to have these run synchronously. DE 30 49 357 A1 to Horn GmbH likewise discloses a frame where the height-adjustable legs are driven by a motor located in the middle of the frame and where the motor has a through-going shaft extending to the two legs.

The purpose of the invention is to provide a frame for tables, which can be assembled in a simple and non-time-consuming manner. This is achieved according to the invention in that the motor unit is arranged in the longitudinal member and connected to the drive mechanism in the height-adjustable legs. Thus, a frame having a simplified construction is achieved. The construction of the legs can be simplified and the dimensions reduced as it is not necessary to take the building-in of a motor into the legs into consideration. As both legs are driven by a common motor unit, the electrical control may also be simplified as it will not have to drive two motors synchronously.

SUMMARY OF THE INVENTION

In an embodiment of the invention, a mounting bracket for mounting the leg to the longitudinal member is secured to the upper end of a profile. This eases the mounting as the legs equipped with mounting brackets are immediately ready for mounting.

In a special embodiment, the mounting bracket is U-shaped and has an internal cross section which corresponds to the outer cross section of the longitudinal member, such that this can rest therein. As the legs are typically located at the ends of the longitudinal member, the U-shaped bracket contributes to stabilizing the shape of the longitudinal member. This especially applies when the U-shaped bracket with the side walls is fitted in a close-fitting manner over the sides of the longitudinal member.

For mounting of the legs on the longitudinal member, this is in an embodiment equipped with a pair of axle journals on its outer side for cooperation with a pair of recesses intended for that purpose in the end of the mounting bracket of the leg which faces towards the middle of the longitudinal member. When the leg is mounted, this is held in an angular position such that its mounting bracket with the recesses is guided over the two axle journals on the outer side of the longitudinal member, after which the leg is turned to a vertical position.

In a further development of the invention, the outer side of the longitudinal member is equipped with a pair of pins which cooperate with a pair of tracks in the mounting bracket. This provides a further fixation of the legs. The axle pins and the cooperating recesses in the end of the mounting bracket lock this against movement in the vertical direction while the pins and the cooperating tracks from the upper edge of the mounting bracket retains this against movement in the axial direction of the longitudinal member.

In an embodiment of the invention, the respective ends of the longitudinal member are equipped with a pawl unit and in the side walls of the mounting bracket two slits are constructed intended for engagement with the two pawls which protrude out from the side walls in the longitudinal member. When the legs with the mounting bracket are placed over the longitudinal member, the two pawls in the pawl mechanism will be pressed back and when the mounting bracket with the two slits is positioned opposite the pawls, they will snap forth and enter into engagement with these. The legs are thus finally locked to the longitudinal member. The vibrations and shaking arising during the use of the table causes the pawls of the pawl unit to"gnaw" themselves further into engagement with the longitudinal member, thus increasing the firmness of the locking of the two parts of the frame. If, for some reason, it should be desired to dismantle the legs, this can be done by pressing the pawls back such that they release their engagement with the slits and tilting the leg backwards.

In a special embodiment, the pawl unit comprises a housing, the outer shape of which corresponds to the internal shape of the longitudinal member. Two pawls are embedded in the housing, said pawls protrude through a fissure in each side of the housing, and the two pawls are spring-loaded by a coil spring mounted between the two pawls. The pawl unit can thus as a separate unit be mounted in the longitudinal member. In an embodiment, the housing of the pawl unit is secured not only with the two pawls but also with a cam on each side of the housing, which when mounted are positioned in recesses intended for that purpose in the side walls of the longitudinal member.

In an embodiment for the invention, the longitudinal member is constituted by a middle section and two end sections, which are longitudinally displaceably embedded in the middle section. Thus, the length of the longitudinal member can in a simple manner be adapted to the length of the present table top, preferably by symmetric displacement of the two end sections.

In a special embodiment of the middle section having a U-shaped cross section, the side walls are terminated in a protruding flange, which is bend to form a groove, and where the end sections likewise have a U-shaped cross section which fits into the middle section, and where the side walls are terminated in a protruding flange, which fits into the groove in the middle section. This contributes to a stable shape of the longitudinal member as a whole and further provides a stable guiding of the end sections. As the side walls of the U-shaped bracket are constructed such that they with the upper edge rest against the lower edge of the protruding flanges on each side of the longitudinal member, this further contributes to increasing the stability of the joining of the legs with the longitudinal member.

In an embodiment of the invention, a cross member is secured to the free ends of the two end sections of the longitudinal member, said cross member having a side wall, the height of which corresponds to the height of the longitudinal member, and at the top, the side wall continues as a protruding flange, which is level with the flanges of the longitudinal member. When the cross members are secured to the table top, it does not only provide stability to the frame, it also supports the long sides of the table top.

In a special embodiment, the cross member is equipped with a bracket at the lower edge, said bracket has a perpendicular portion protruding from the lower end of the cross member, which at its free edge is terminated in a perpendicular flange. The bracket can be screwed or welded on but is expediently constructed as one with the cross member. In a further embodiment, there is a slit in the side wall of the cross member at either side of the bracket. Thus, a particularly safe mounting of the cross member can be achieved without the use of tools as the cross member can be mounted onto the longitudinal member by inserting the perpendicular flange on the bracket into a cross slit intended for that purpose in the bottom of the longitudinal member, while the slits in the side wall of the cross member grips over protruding flanges intended for that purpose in the side walls of the longitudinal member. In an embodiment of the invention, the motor unit is mounted in the longitudinal member and is in driving connection with the driving mechanisms of the height-adjustable legs. In a special embodiment, the motor unit comprises a housing with a cover, which as a rule eases the mounting of the motor unit in the longitudinal member. In a further development of the invention, the housing is divided into two chambers, one for the motor unit and another for an electrical control, which comprises a printed circuit board, among other things with a mains socket which is accessible through a hole in the side of the longitudinal member, and separate from the mains socket are at least two low voltage sockets, which are accessible through a hole in the other side of the longitudinal member. The housing can in that respect be made from a synthetic material, such that the electrical part becomes isolated from the cross member, which is typically bent from metal plates.

In an embodiment of the motor unit, this comprises an electric motor and a gear in the form of a worm gear with a worm in extension of the motor shaft and in engagement with a worm wheel, and where the side of the worm wheel is furnished with one part of the spline coupling for cooperating with the other part of the spline coupling arranged on the driving mechanism of the legs. This enables an easy joining of the drive unit of the legs and the motor unit, as the two parts of the spline coupling merely will have to be brought into engagement with each other.

In a further embodiment, the motor unit is connected to a drive shaft which runs through the longitudinal member to at least one of the legs. The motor unit is expediently placed above one of the legs, such that the leg immediately can be connected to the motor unit, by which only one drive shaft is needed, i.e. only one drive shaft will have to be adjusted to the length of the longitudinal member.

In a special embodiment of the invention, a toothed wheel is mounted to the end of the drive shaft, said toothed wheel is in engagement with the worm wheel of the motor unit, and the opposite end of the drive shaft is in engagement with a corresponding worm gear, where the end of the drive shaft is in engagement with the worm, which further is in engagement with the worm wheel, which through a spline coupling is in engagement with the drive unit of the leg. The same gear can thus be used in both the drive shaft and the motor unit, thus keeping the number of components down.

In an embodiment, the drive shaft is telescopic, such that this in a corresponding manner as the longitudinal member can be adapted to the present length of a given table. The drive shaft can thus be premounted in the longitudinal member and automatically adapted by adapting the longitudinal member to the desired length. In a special embodiment, the drive shaft consists of three parts, where the two parts, which are in engagement with the motor unit and the gear at the other end of the longitudinal member, respectively, are tubes, while the middle section is a solid rod, which with the ends is received in the two tube portions, and that the cross section is multi-edged such that the rotation from the motor can be transferred to the drive unit for the leg at the other end of the longitudinal member.

The invention further relates to a height-adjustable table comprising a frame according to one or more of the claims 1-19.

BRIEF DESCRIPTION OF THE DRAWINGS

The invention will be explained more fully below with reference to the embodiment shown in the accompanying drawing.

DETAILED DESCRIPTION OF EMBODIMENTS

Figure 18:
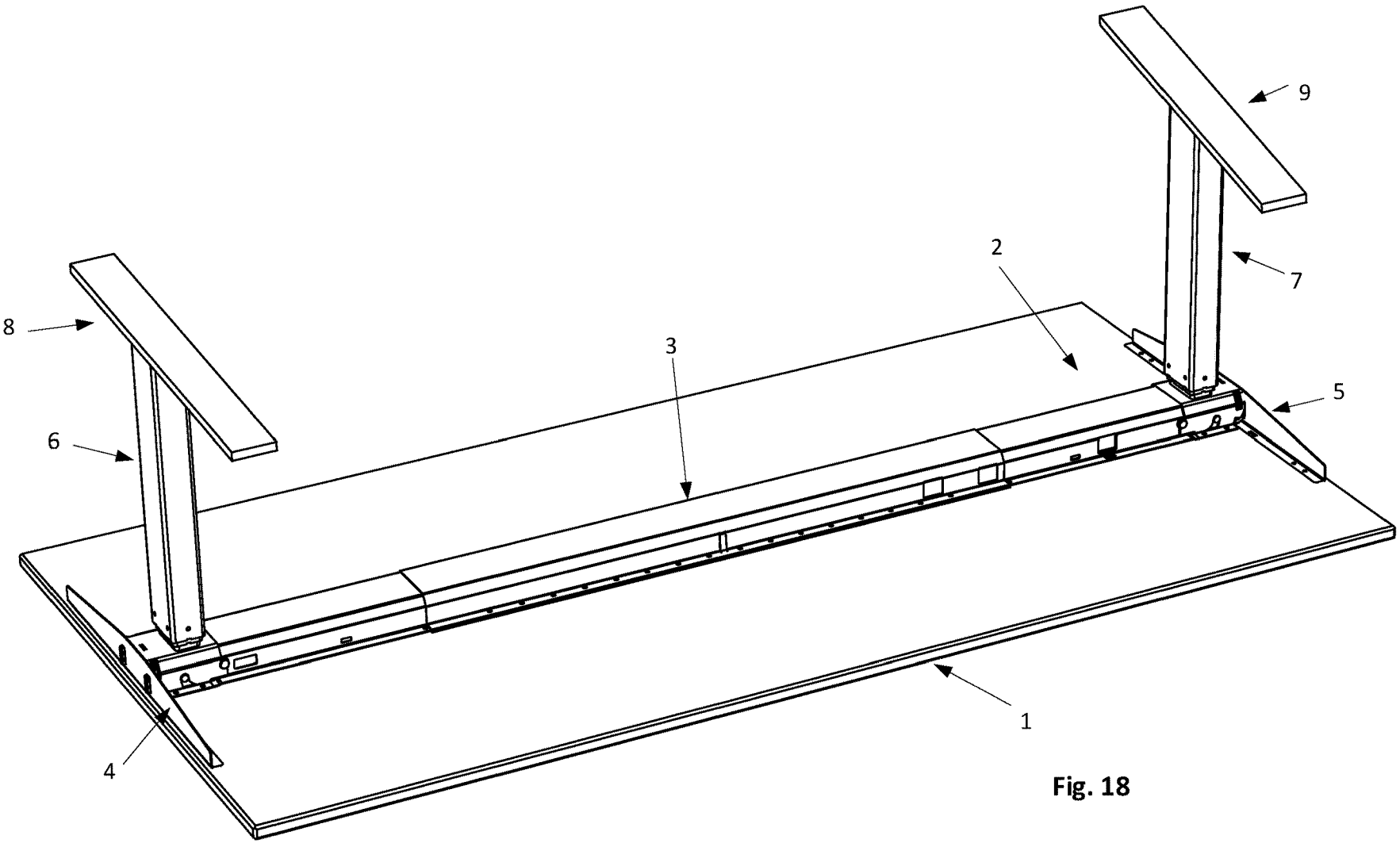
FIG. 18, shows the same as FIG. 16 but where the feet are indicated mounted on the lower end of the legs.
Figure 20:
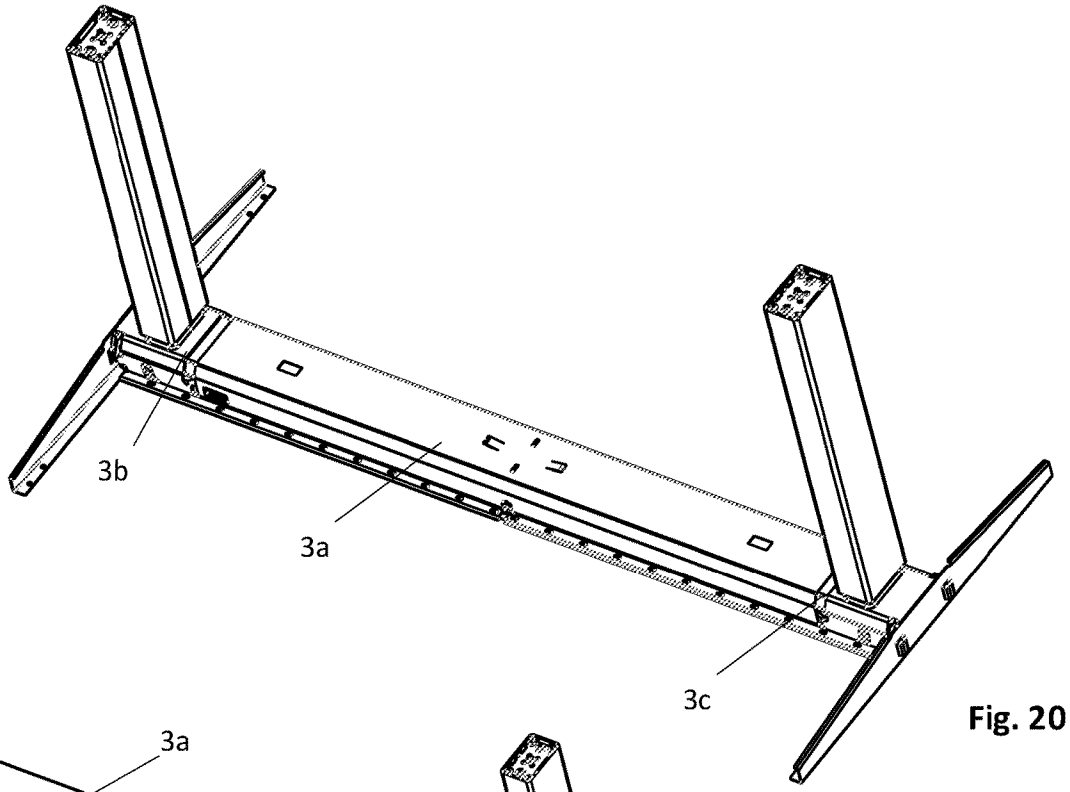
FIG. 20 shows the frame in its shortest length, i.e. with the longitudinal member in its fully retracted length.
Figure 19:
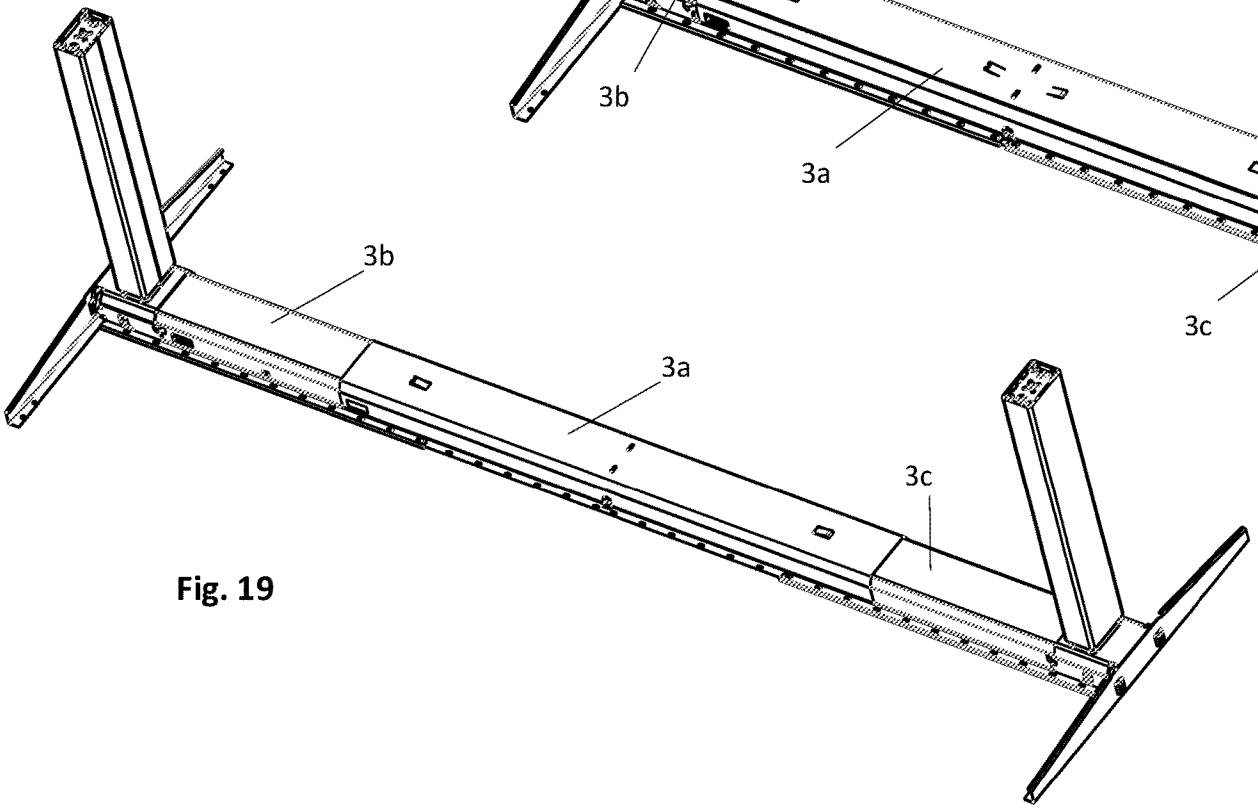
FIG. 19 shows the frame in its maximum length, i.e. with the longitudinal member in its maximum extended position.

The height-adjustable table shown in FIG. 18 comprises a table top 1 and a frame 2 on which the table top is mounted. The frame comprises a length-adjustable longitudinal member 3, two cross members 4,5, one mounted to each end of the longitudinal member, a pair of height-adjustable legs 6,7, also called lifting columns, which with an upper end are mounted to the longitudinal member at either end thereof, and two feet 8,9, one mounted to a lower end of each height-adjustable leg.

Figure 2:
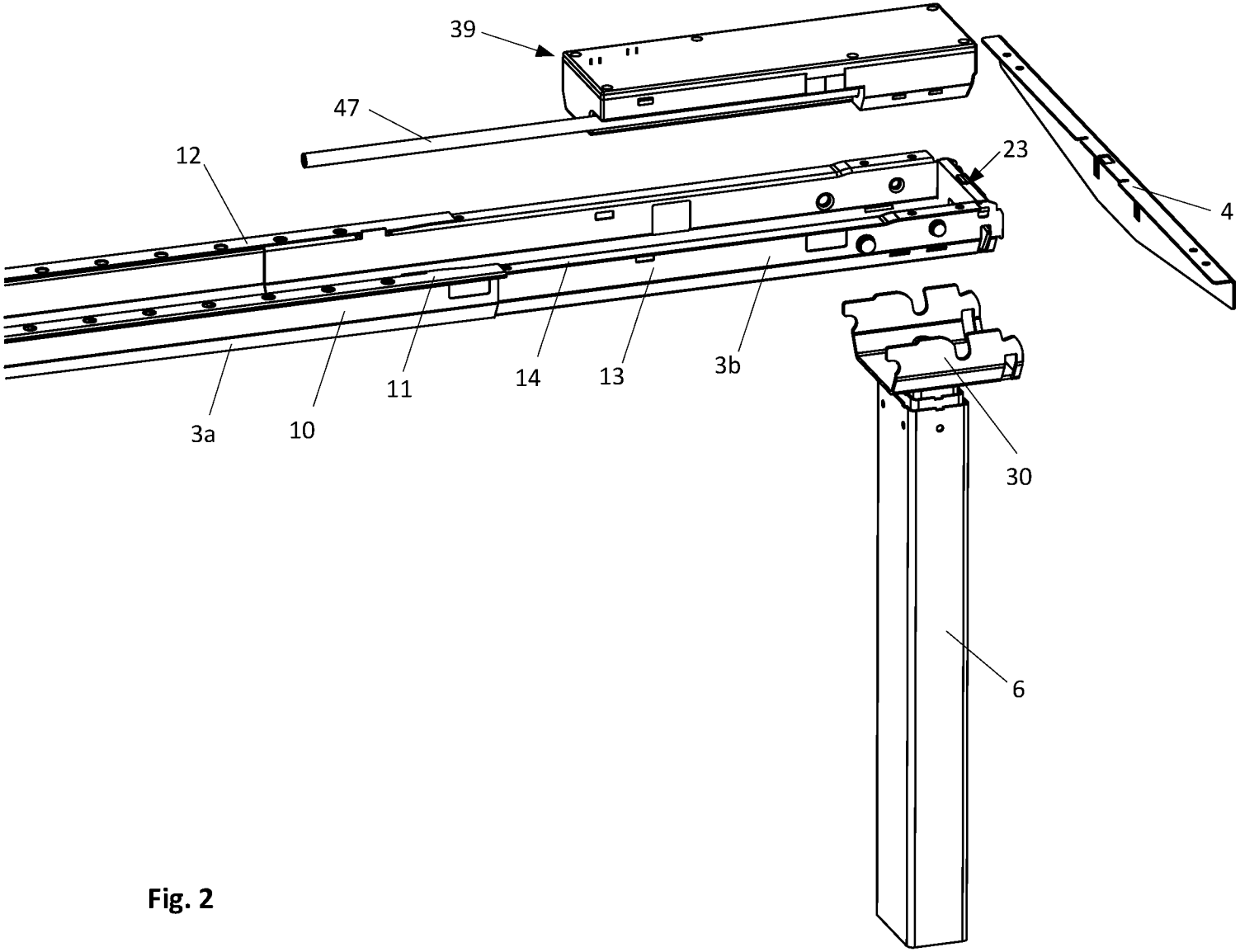
FIG. 2 shows an exploded view of one end of the frame shown in FIG. 1.
Figure 3:
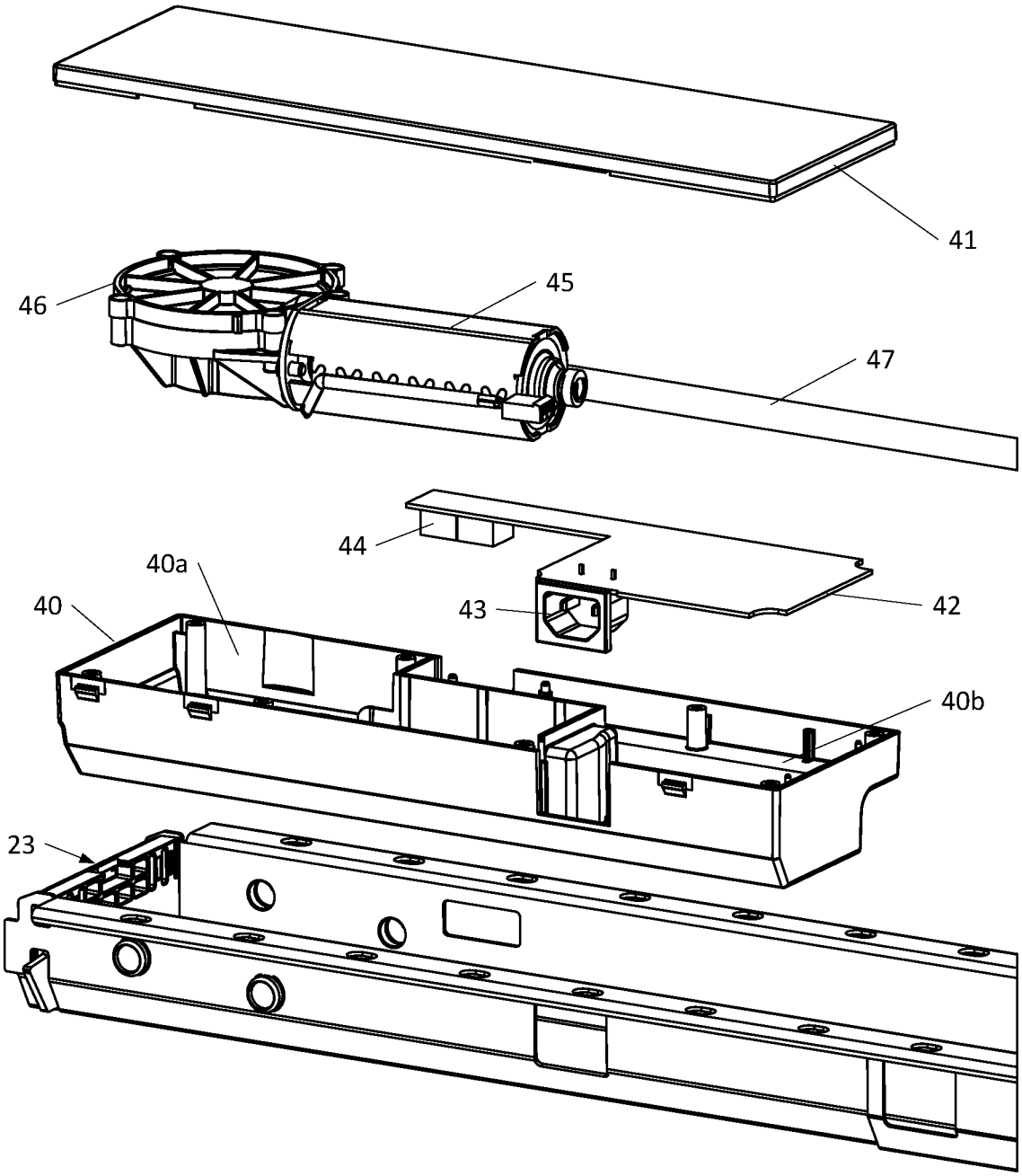
FIG. 3 shows an exploded view of the end of the longitudinal member with the motor unit.
Figure 4:
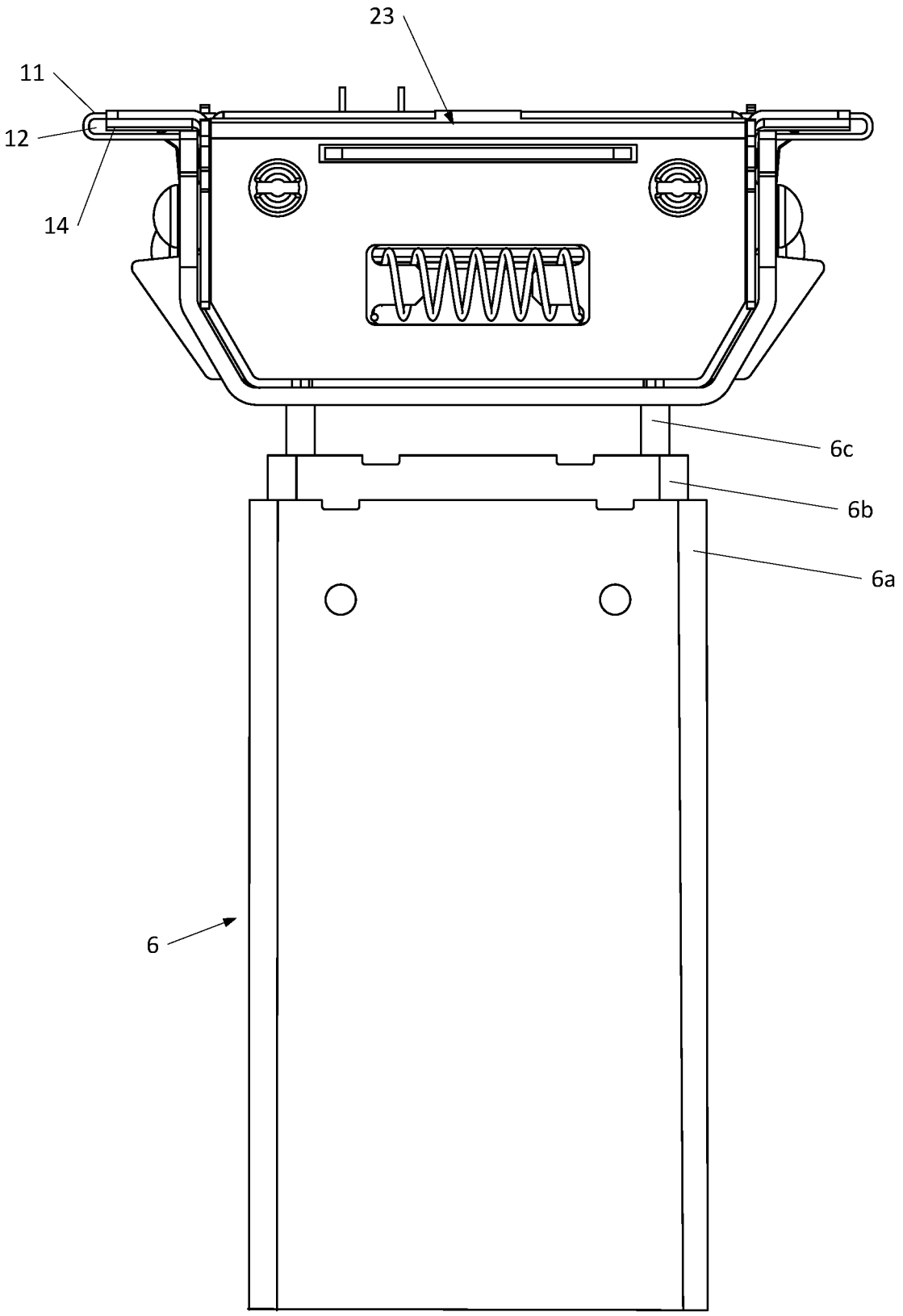
FIG. 4 shows the end of the longitudinal member with mounted legs and shown without crossbar.
Figure 5:
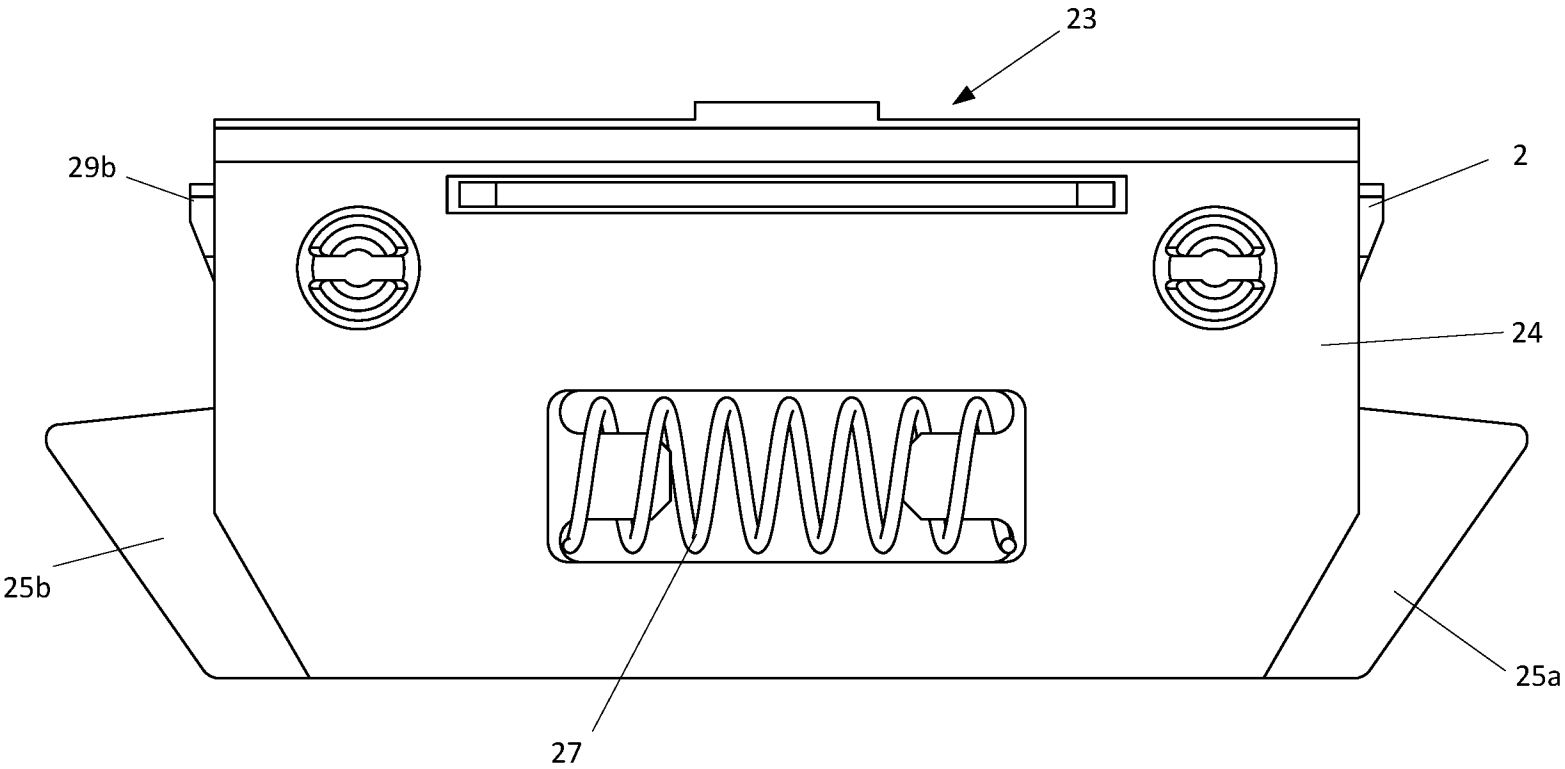
FIG. 5 shows the pawl unit seen directly from the side and with the pawls shown in their fully extended position.
Figure 6:
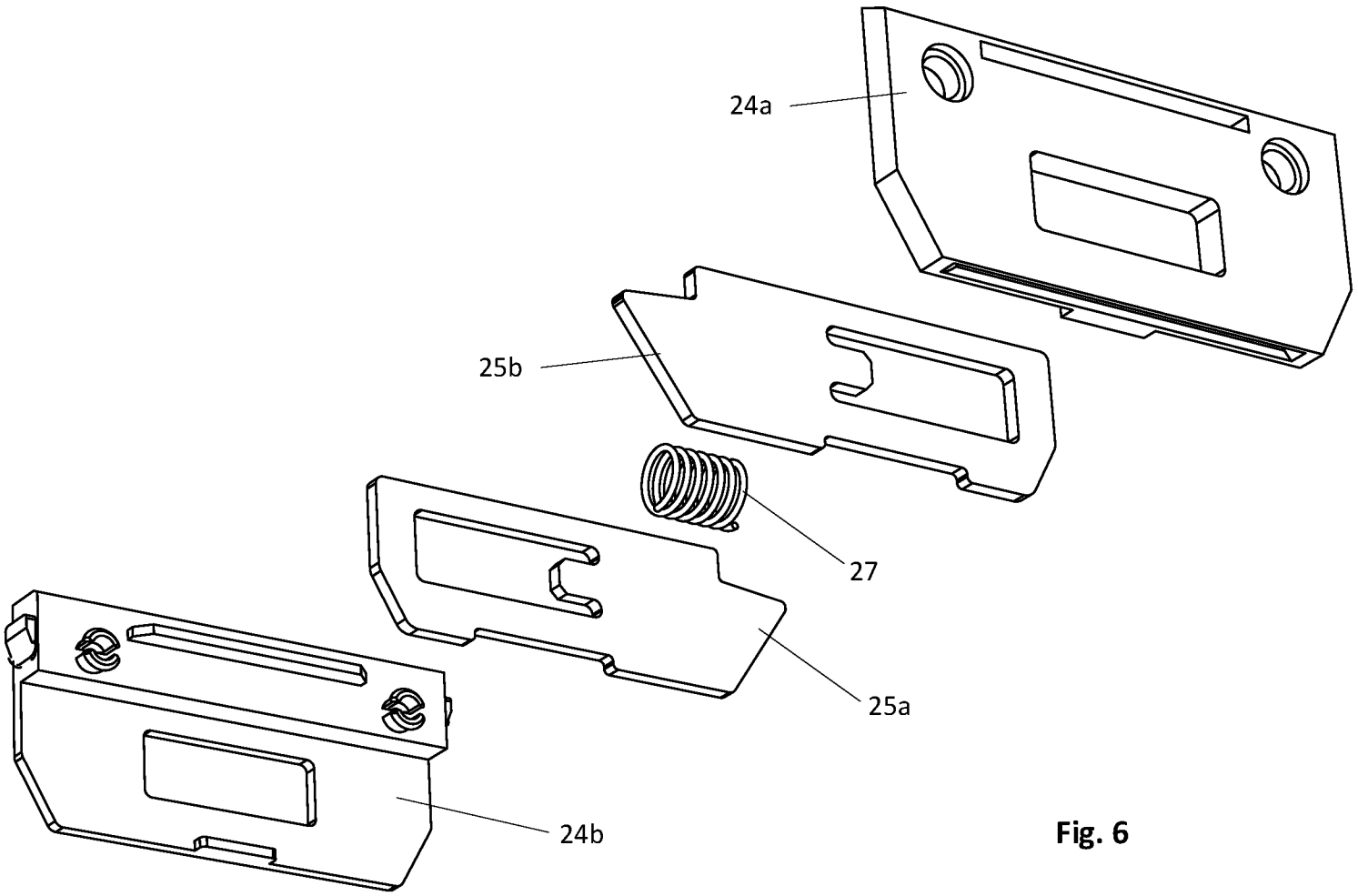
FIG. 6 shows an exploded view of the pawl unit.
Figure 7:
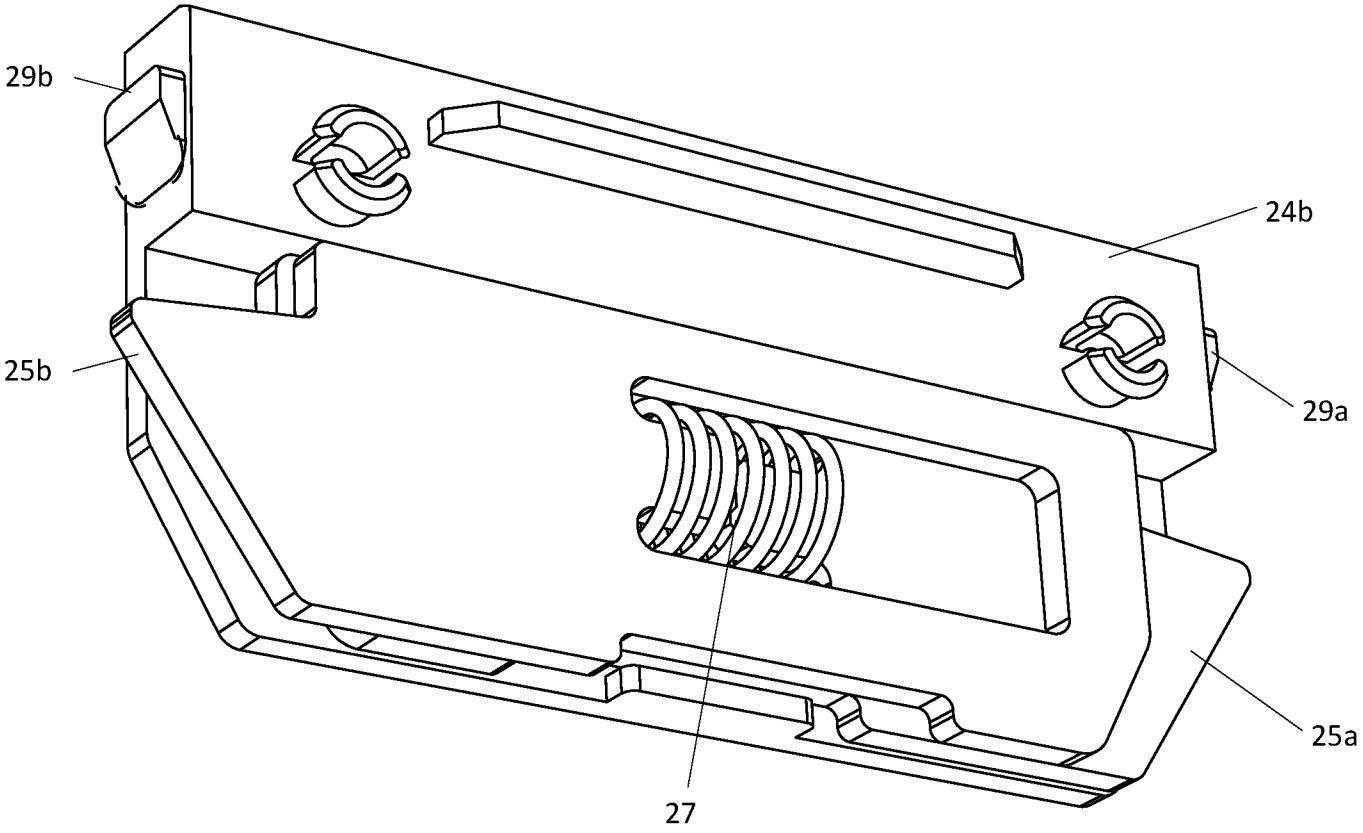
FIG. 7 shows the pawl unit shown with one side wall removed.
Figure 8:
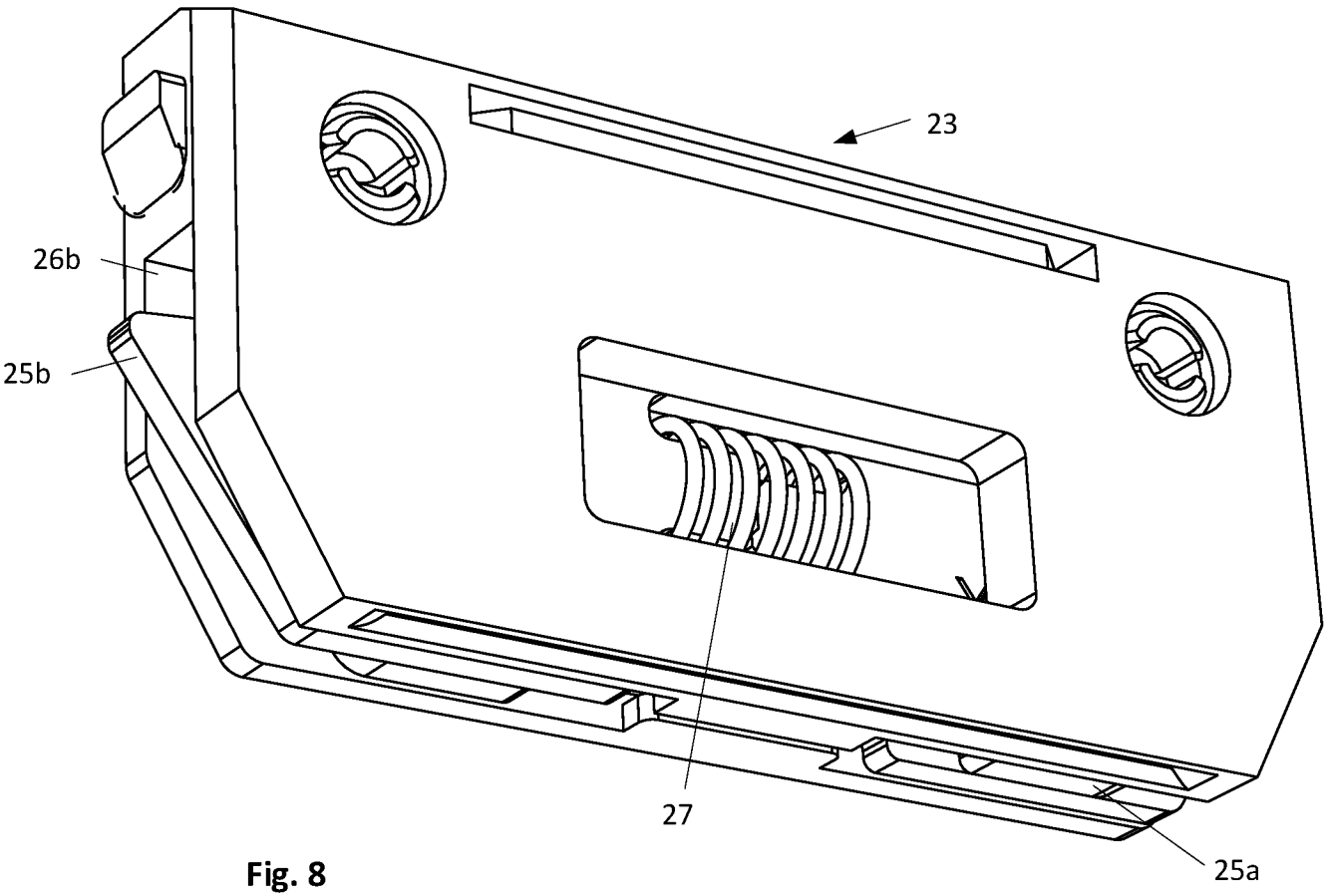
FIG. 8 shows a perspective view of the pawl unit where the pawls are shown retracted.
Figure 9:
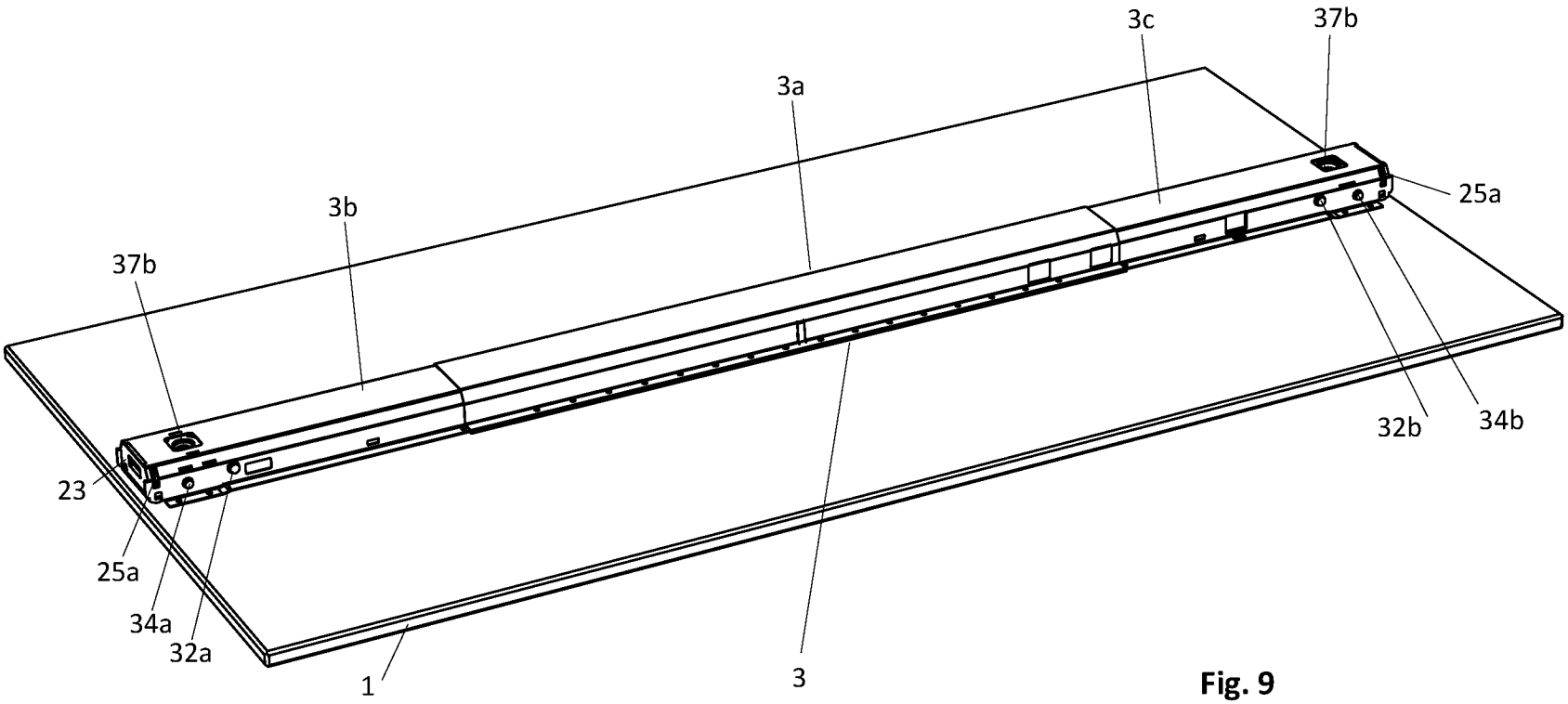
FIG. 9 shows the longitudinal member mounted to the underside of a table top.

The longitudinal member 3 is constituted by a middle section 3 a and two end sections 3*b*, 3*c*, which are longitudinal displaceably mounted in the middle section 3*a* for adaption of the length of the longitudinal member to the actual length of the table top. The middle section 3*a* has a U-shaped cross section, where the side walls 10 terminate in an outwardly extending flange 11 which is folded to form a groove 12. The two displaceable end sections 3*b*, 3*c* also have a U-shaped cross section fitting into the middle section 3*a* and where the side walls 13 terminate in an outwardly extending flange 14 fitting into the groove in the middle section, see FIGS. 2 and 4.

Figure 10:
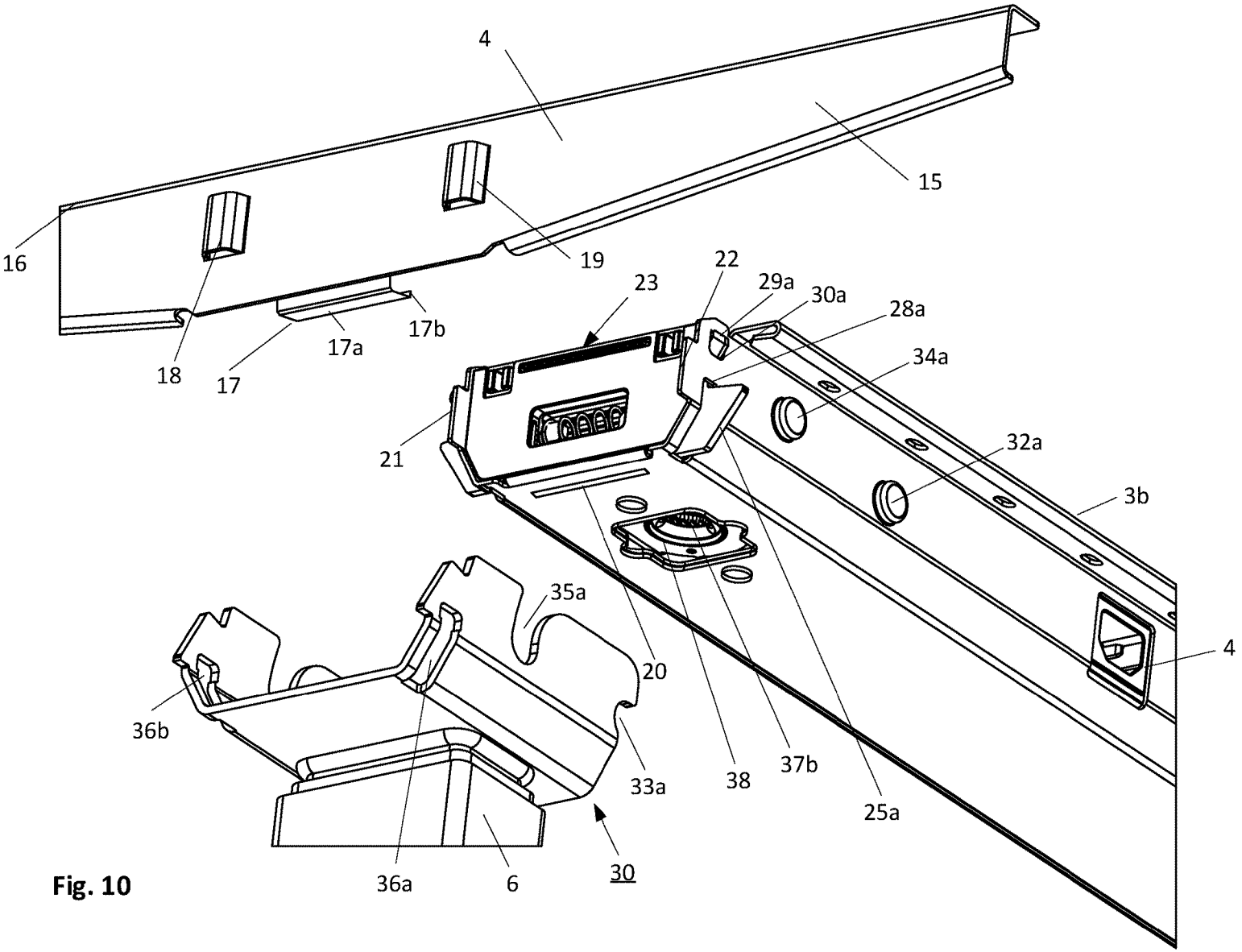
FIG. 10 shows an exploded view of the end of one end of the frame.
Figure 11:
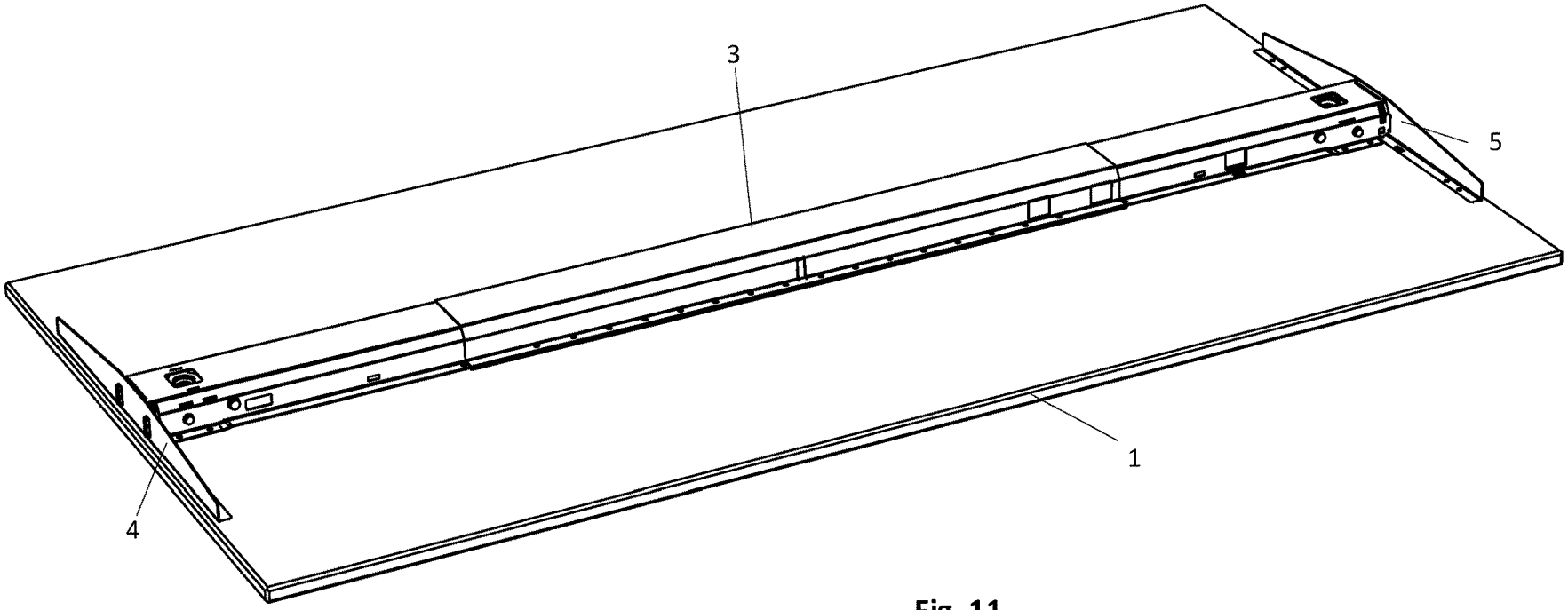
FIG. 11 shows the same as FIG. 5, but where the cross members are mounted to the ends of the longitudinal member.

To the free ends of the two end sections 3*b*, 3*c* of the longitudinal member a cross member 4,5 is secured, said cross member 4,5 has a side wall 15, the height of which corresponds to the height of the longitudinal member 3. At the top, the side wall extends into a protruding flange 16, which is level with the flanges 14 of the longitudinal member 3. At the lower edge, the cross member has a bracket 17 with a perpendicular portion 17*a* protruding from the lower end of the cross member, which at its free edge is terminated in a perpendicular flange 17*b*. The side wall of the cross member has a slit 18,19 at either side of the bracket. The cross member 4,5 is mounted on the longitudinal member 3 by inserting the perpendicular flange 17*b* into a cross slit 20 intended for that purpose in the bottom of the longitudinal member 3, while the slits 18,19 in the side wall 15 of the cross member grip over protruding flanges 21,22 intended for that purpose in the side walls of the longitudinal member 3, see FIG. 10.

At the free end of the longitudinal member 3 a pawl unit 23 is mounted which comprises a housing 24, the outer shape of which corresponds to the internal shape of the longitudinal member. Two pawls 25*a*, 25*b* are embedded in the housing 24, said pawls 25*a*, 25*b* protrude through a fissure 26*a*, 26*b* in each side of the housing. The two pawls are spring-loaded by a coil spring 27, mounted between the two pawls. In the side walls of the longitudinal member there is a recess 28*a*, 28*b* in each side for the two pawls. When the housing 24 with the two pawls is inserted into the longitudinal member 3, the two pawls will automatically, due to the pre-tensioning of the spring be pressed out through the two fissures in the side of the longitudinal member. The housing 24 is further retained by a cam 29*a*, 29*b* on each side of the housing, said cams will, when mounted, rest in recesses 30*a*, 30*b* in the side walls of the longitudinal member intended for that purpose, see FIGS. 5-8.

Figure 12:
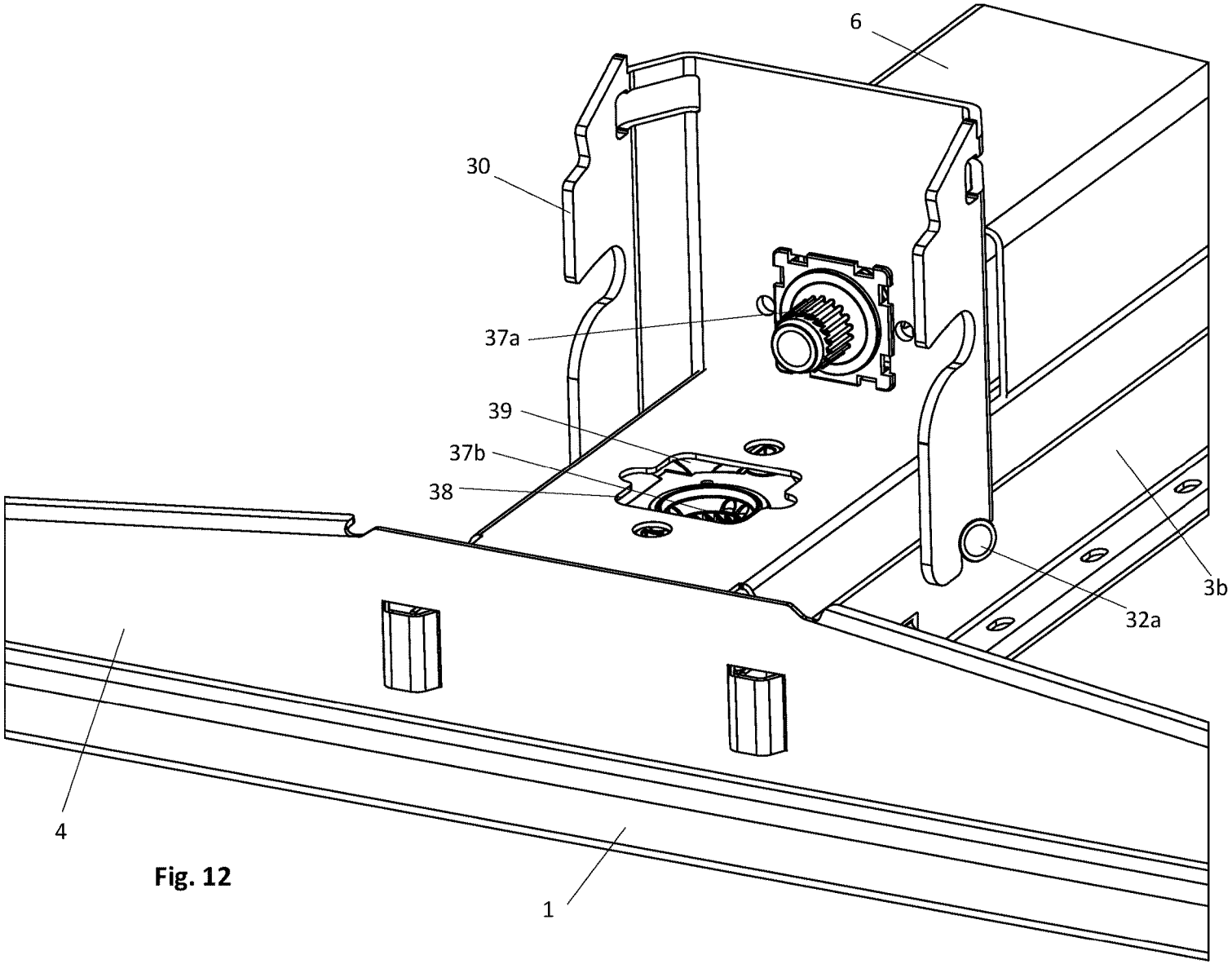
FIG. 12 shows a close-up illustration of the end of the longitudinal member shown with a leg ready for mounting to this.

The height-adjustable legs 6,7 comprise three telescopic profiles, namely an outer profile 6*a*, an intermediate profile 6*b* and an inner profile 6*c*, where the lower end of the outer profile has a bottom part with screw holes for mounting of a foot 8,9. A mounting bracket 31 for mounting of the leg to the longitudinal profile is secured to the upper end. The mounting bracket 31 has a U-shaped cross section and has an internal cross section corresponding to the outer cross section of the longitudinal member 3, such that this can rest therein. For mounting of the longitudinal member 3 this is on the outer side equipped with a pair of axle journals 32*a*, 32*b* for cooperating with a pair of recesses 33*a*, 33*b* intended for that purpose located at the end of the mounting bracket 31 of the leg facing towards the center of the longitudinal member 3. When the leg 6 is mounted, this is held in a horizontal position against the longitudinal member 3, see FIG. 12, such that its mounting bracket with the recesses 33*a*, 33*b* is placed over the two axle journals 32*a*, 32*b* on the outer side of the longitudinal member 3. For additional fixation of the leg 6, the external side of the longitudinal member is equipped with a pair of journals 34*a*, 34*b* for cooperating with a pair of tracks 35*a*, 35*b* in the mounting bracket 30, said tracks run from the upper edge of the mounting bracket. The axle journals 32*a*, 32*b* and the cooperating recesses 33*a*, 33*b* in the end of the mounting bracket 30 lock the leg against movement in the vertical direction, while the journals 34*a*, 34*b* and the cooperating tracks 35 *a*, 35*b* from the upper edge of the mounting bracket retains this against movement in the axial direction of the longitudinal member 3. Finally, the mounting bracket is locked at the front end by means of the pawl unit 23 at the end of the longitudinal member as two slits 36*a*, 36*b*, intended for engagement with the two pawls 25*a*, 25*b* which protrude from the side walls in the longitudinal member, are constructed in the sidewalls of the mounting bracket 30. Moreover, the securing of the leg is as a rule stabilized in that the U-shaped bracket 30 with the side walls is fitted in a close-fitting manner over the side of the longitudinal member 3 and in addition, the upper edge of the U-shaped bracket 30 rests against the lower edge of the protruding flanges 14 on each side of the longitudinal member 3*b*.

The legs 6,7, also called lifting columns, are equipped with a driving mechanism in the form of a spindle unit comprising a solid spindle and a hollow spindle as well as a drive tube. The spindle unit is with its one side secured to the outer tube and with the other end secured to the inner profile, while the intermediate profile is secured to the hollow spindle such that it is guided synchronously with the inner profile. To the upper end of the drive tube, a pin 37*a* of a spline coupling is secured. At the bottom of the longitudinal member a hole 38 is constructed, which the spline coupling pin protrudes through, see FIG. 12.

Figure 1:
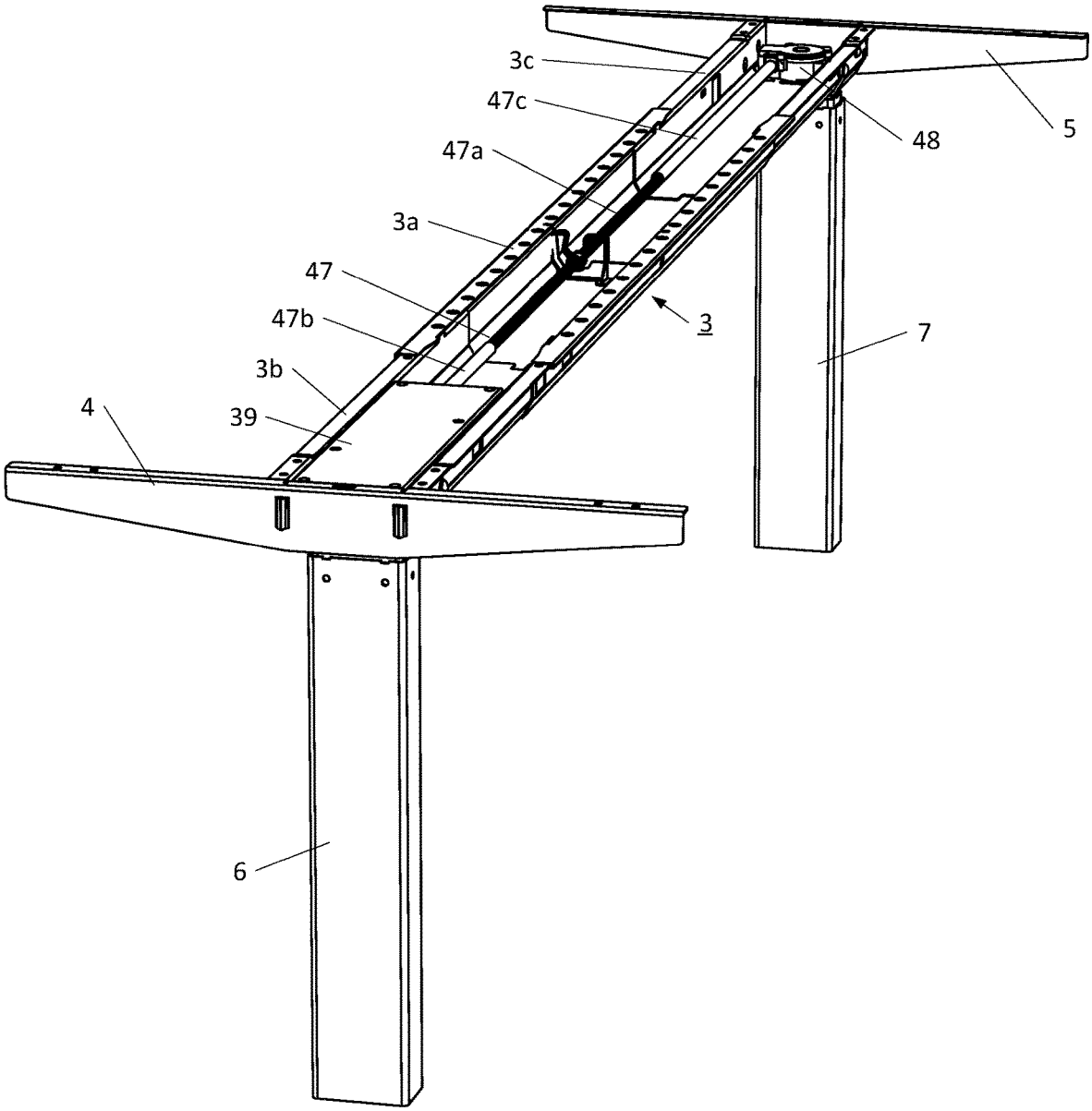
FIG. 1 shows a perspective view of an assembled frame seen from above, but shown without feet.
Figure 13:
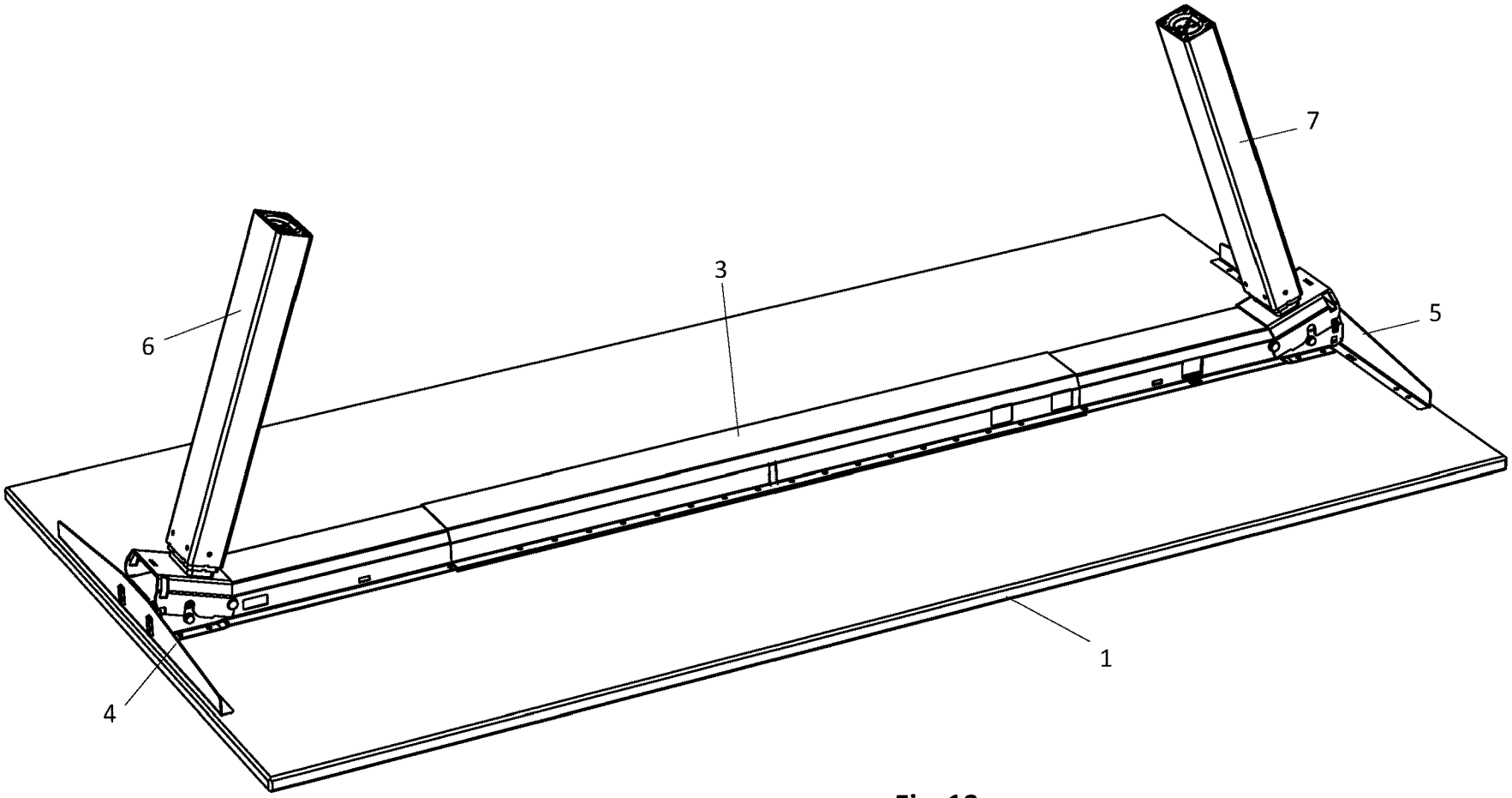
FIG. 13 shows the same as FIG. 11 but shown with the legs partially mounted.
Figure 14:
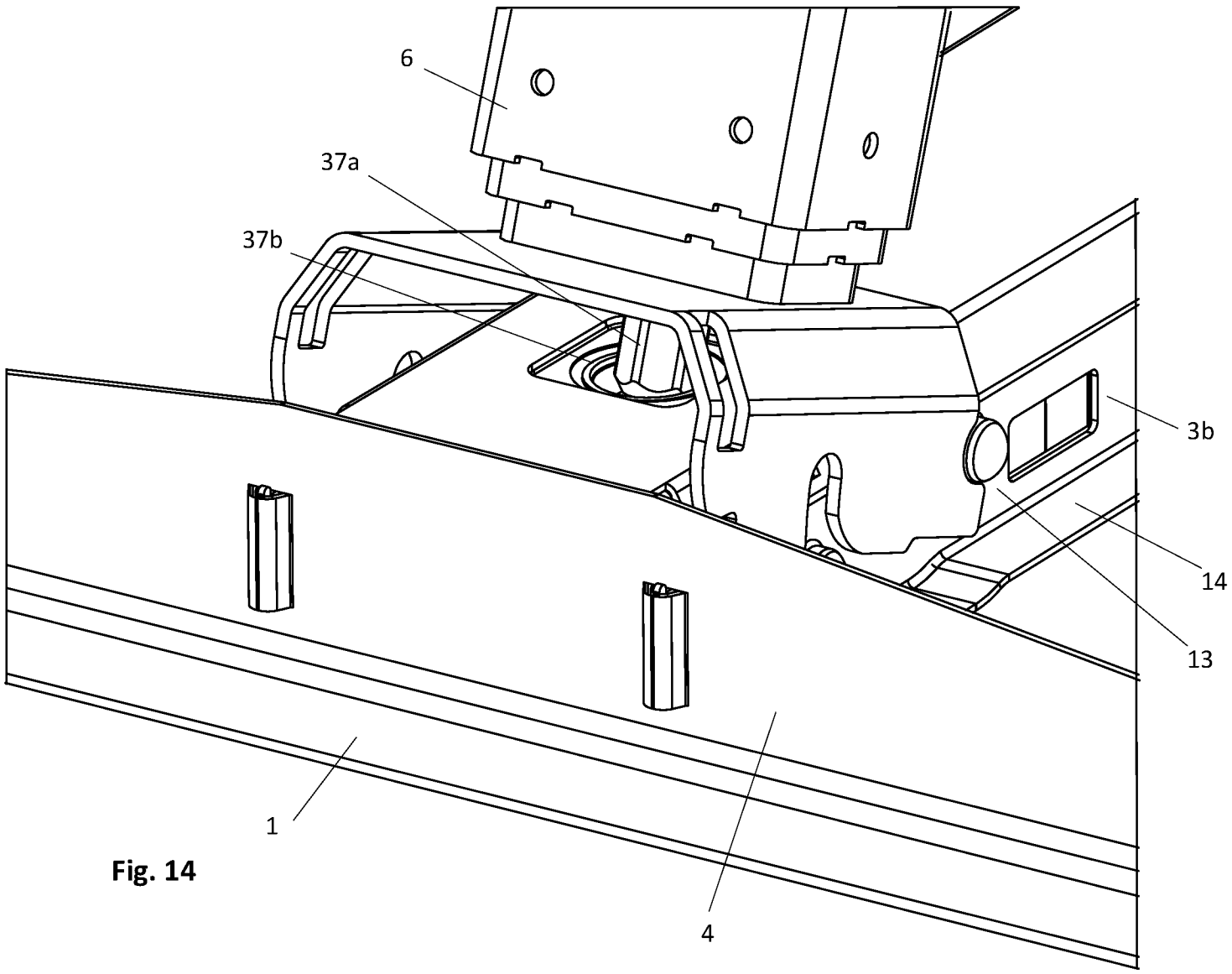
FIG. 14 shows a close-up illustration of the end of the leg in the same position as shown in FIG. 13.
Figure 15:
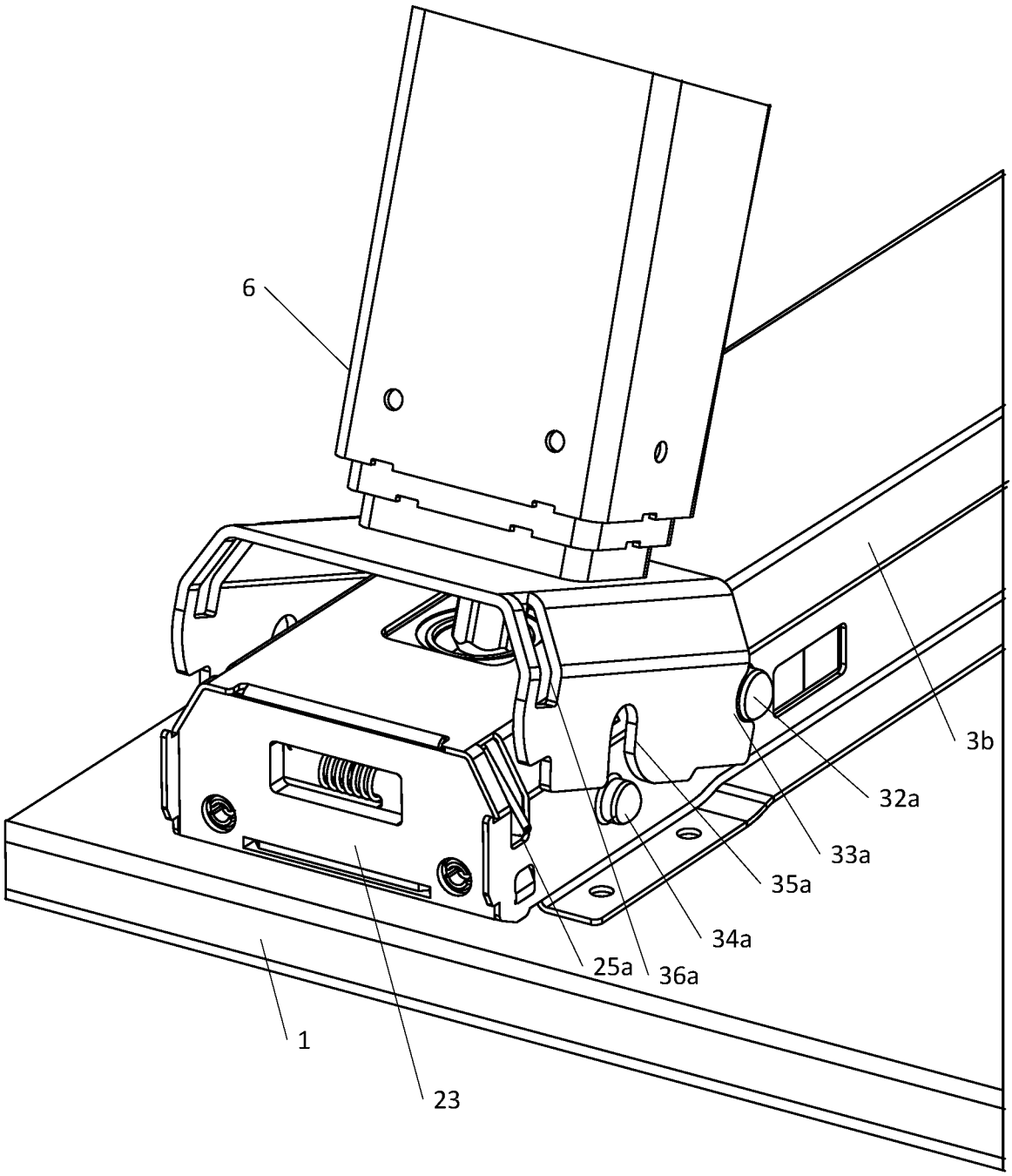
FIG. 15 shows the same as FIG. 14, but where the longitudinal member for the sake of clarity is shown without cross member.
Figure 16:
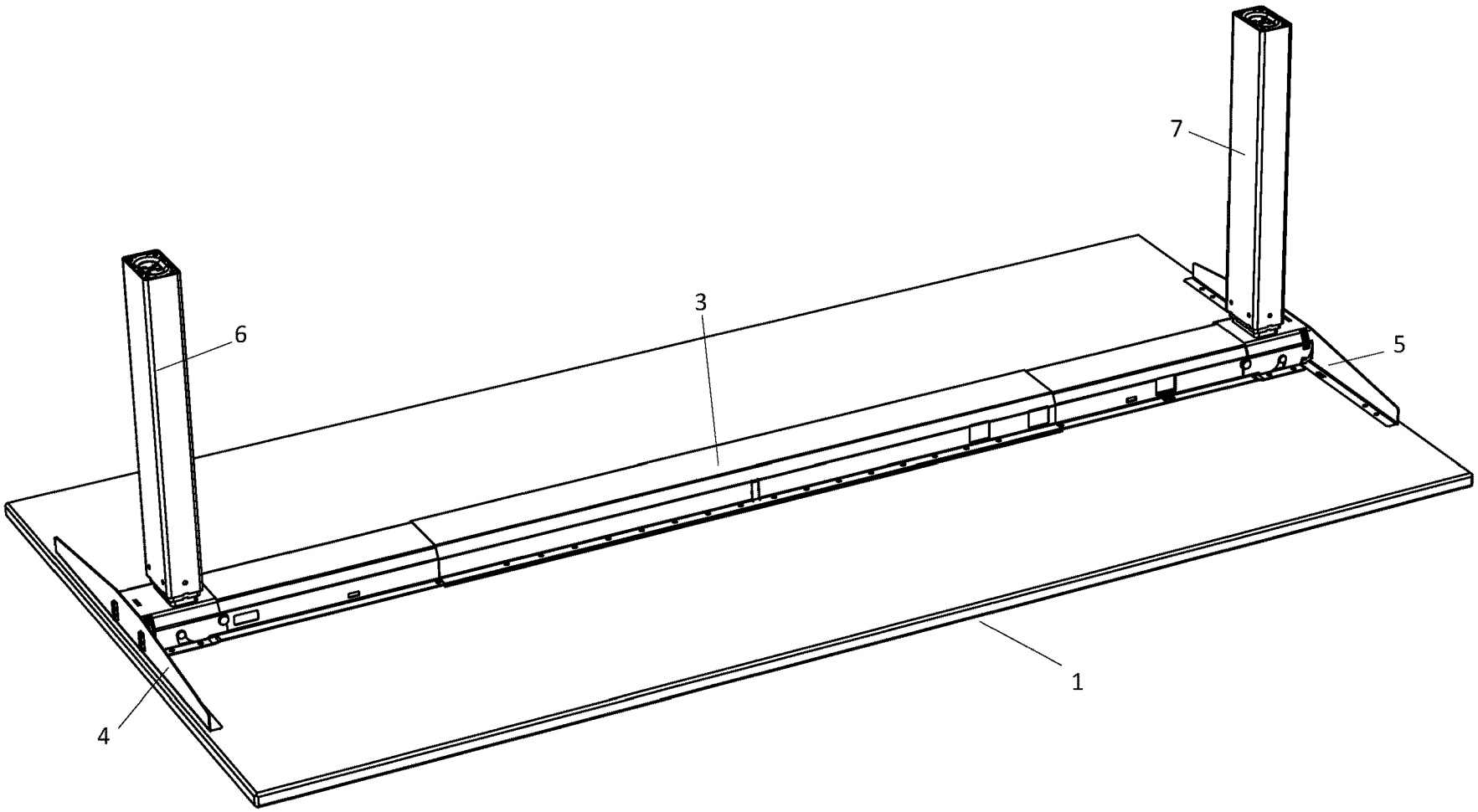
FIG. 16 shows the same as FIG. 13, but with the legs shown in the fully mounted position.
Figure 17:
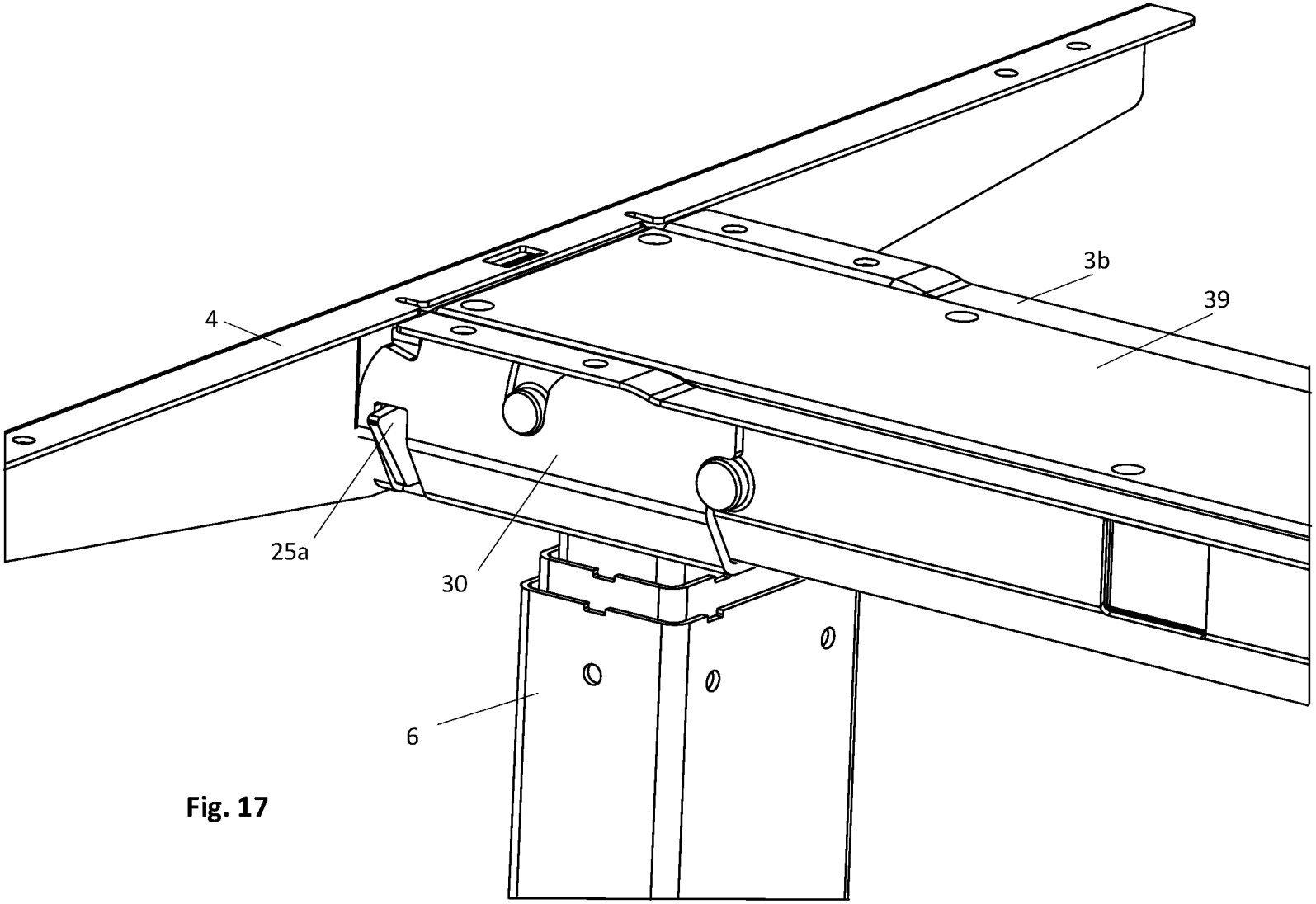
FIG. 17 shows a close-up illustration of one end of the longitudinal member with cross member and the leg shown in its final mounted position.

In the longitudinal member 3, a motor unit 39 is mounted, which comprises a housing 40 with a cover 41, see FIG. 13. The housing is divided into two chambers 40*a*, 40*b*, one for the motor unit 39 and another for the electrical control, which comprises a printed circuit board 42, among other things with a mains socket 43 which is accessible through a hole in the side of the longitudinal member 3. Separate from the mains socket are two low voltage sockets 44, which are accessible through a hole in the other side of the longitudinal member. The motor unit 39 comprises an electric motor 45 and a gear 46 in the form of a worm gear with a worm in extension of the motor shaft and in engagement with a worm wheel. On the side of the worm wheel, the other part of the spline coupling is constructed, i.e. a recess 37*b* for receiving the spline coupling pin 37*a*, see FIG. 12. Moreover, the motor unit is connected to a drive shaft 47 which runs through the longitudinal member 3 to the other leg 7, see FIG. 1. At the end of the drive shaft, a toothed wheel is mounted, which is in engagement with the worm wheel of the motor unit. At the opposite end, the drive shaft 47 is in engagement with a corresponding worm gear 48, where the end of the drive shaft is in engagement with the worm, which further is in engagement with the worm wheel, which through a spline coupling is in engagement with the drive unit of the legs 5. It is noted that the drive shaft 47 is telescopic, such that this in a corresponding manner as the longitudinal member 3 can be adapted to the present length of a given table.

The drive shaft 47 consists of three parts, where the two parts 47*b*, 47*c*, which are in engagement with the motor unit 39 and the gear 48 at the other end of the longitudinal member, respectively, are tubes, while the middle section 47*a* is a solid rod, which with the ends is received in the two tube portions 47*b*, 47*c*. The cross section is multi-edged such that the rotation from the motor can be transferred to the drive unit for the leg at the other end of the longitudinal member.

The drive mechanism for bringing about the telescopic movement of the legs comprises a spindle unit, consisting of a solid spindle and a hollow spindle both having external threads. At the lower end of the hollow spindle, a spindle nut for the solid spindle is secured, said spindle nut is constructed as a bushing with internal threads. By rotating the hollow spindle, the spindle nut will screw itself up solid spindle as this is retained against rotation at its free end. The hollow spindle is surrounded by a drive tube furnished with a number of axially running grooves on its inner side. At the upper end of the hollow spindle, a ring is secured to the external side thereof, said ring having a number of fins on its outer side, which protrude into the grooves of the drive tube. A support tube surrounds the drive tube and at the lower end of the support tube a spindle nut for the hollow spindle is secured. The spindle nut is in the shape of a bushing with internal threads. When the drive tube is rotated, the support tube will screw itself up the hollow spindle as the support tube at its upper end is secured against rotation. As the hollow spindle is driven around, this will screw itself synchronously up the solid spindle, as previously explained, i.e. the axial movement is the joint movement of both the hollow and solid spindle. The drive tube is driven by the motor unit via the spline coupling.

It is understood that elements or principles from the embodiment can be combined with consideration for the specific usage of the frame. The invention is here in particular mentioned in connection with sit-stand desks, but it is understood that the invention can also be used in connection with other types of tables such as work tables, counters, kitchen tables etc. It is furthermore noted that even though the invention initially is intended for driving one motor unit, the invention can also be realized such that the legs can be manually adjusted e.g. driven by a crank handle.

What is claimed is:

1. A frame for sit-stand-tables comprising a longitudinal member, two height-adjustable legs with at least two telescopic profiles, namely an outer and an inner profile, and with a driving mechanism, driven by a motor unit, comprising an electric motor and a gear, wherein the motor unit is connected to a drive shaft running through the longitudinal member, the draft shaft being connected to at least one of the height-adjustable legs, and wherein the longitudinal member has an adjustable length and the drive shaft is telescopic constructed so as to be adapted to the desired length of the longitudinal member.

2. A frame for sit-stand-tables comprising:

a longitudinal member;

two height-adjustable legs, each have at least two telescopic profiles and a driving mechanism;

a motor unit arranged in the longitudinal member and connected to the driving mechanisms in the height-adjustable legs, the motor unit comprising an electric motor and a gear; and two mounting brackets, each secured to an end of one of the two height-adjustable legs and configured for mounting the leg to the longitudinal member, wherein the mounting bracket is U-shaped and has an internal cross section corresponding to the outer cross section of the longitudinal member such that the longitudinal member can rest in the mounting bracket.

3. The frame according to claim 2, wherein for mounting an external side of the longitudinal member is equipped with a pair of axle journals for cooperating with a pair of recesses intended for that purpose located at an end of the mounting bracket.

4. The frame according to claim 3, wherein the external side of the longitudinal member is equipped with a pair of journals cooperating with a pair of tracks in the mounting bracket, said tracks extending from the upper edge of the mounting bracket.

5. The frame according to claim 2 further comprising a pawl unit arranged at the end of the longitudinal member, wherein side walls of the mounting bracket are constructed with two grooves intended for engagement with two pawls protruding from side walls of the longitudinal member.

6. The frame according to claim 5 wherein the pawl unit comprises a housing, the external shape of which corresponds to the internal shape of the longitudinal member, wherein two pawls are embedded in the housing and protrude through a fissure in each side of the housing, and wherein the two pawls are spring-loaded by a coil spring mounted between the two pawls.

7. The frame according to claim 6, wherein the housing of the pawl unit, in addition to the two pawls, furthermore is secured by a cam on each side of the housing, said cams will when mounted rest in recesses in the side walls of the longitudinal member intended for that purpose.

8. The frame according to claim 1 wherein the longitudinal member is constituted by a middle section and two end sections, which are mounted longitudinal displaceable in the middle section.

9. The frame according to claim 8, wherein the middle section has a U-shaped cross section, where the side walls terminate in an outwardly extending flange which is folded to form a groove, and where the end sections also have a U-shaped cross section fitting into the middle section and where the side walls terminate in an outwardly extending flange fitting into the groove in the middle section.

10. The frame according to claim 1 further comprising a cross member that is secured to the free ends of the two end sections of the longitudinal member, said cross member having a side wall, the height of which corresponds to the height of the longitudinal member, and at its top, the side wall extends into an outwardly extending flange, arranged on a level with the flanges of the longitudinal member.

11. The frame according to claim 10, wherein the cross member at its lower edge has a bracket containing a portion extending perpendicularly outwardly from the lower end of the cross member, said portion terminates into a perpendicular flange at its free edge.

12. The frame according to claim 11, wherein for each side of the bracket, a slit is arranged in the sidewall of the cross member.

13. The frame according to claim 12, wherein a cross slit is arranged at the bottom of the longitudinal member for receiving the perpendicular flange on the bracket of the cross member, and that the slits in the side wall of the cross member reaches over outwardly extending flanges in the side wall of the longitudinal member.

14. The frame according to claim 1 wherein the motor unit is mounted in the longitudinal member and is in driving connection with the driving mechanisms of the height-adjustable legs.

15. The frame according to claim 14, wherein the motor unit comprises a housing with a cover.

16. The frame according to claim 15, wherein the housing is divided into two chambers, one for the motor unit and another for the electric control, which comprises a printed circuit board, among other things comprising a mains socket, which is accessible through a hole in the side of the longitudinal member, and separate from the mains socket there is at least one low voltage socket, which is accessible through a hole in the other side of the longitudinal member.

17. The frame according to claim 1, wherein the motor unit comprises an electric motor and a gear in the form of a worm gear having a worm in continuation of the motor shaft and in engagement with a worm wheel, and where the side of the worm wheel is furnished with one part of a spline connection for cooperating with the other part of the spline connection arranged on the driving mechanism of the legs.

18. The frame according to claim 17, further comprising a toothed wheel that is mounted on the end of the drive shaft, said toothed wheel is in engagement with the worm wheel of the motor unit, and that the opposite end of the drive shaft is in connection with a corresponding worm gear where the end of the drive shaft is in engagement with the worm which further is in engagement with the worm wheel which through a spline coupling is in engagement with the driving unit of the leg.

19. A frame for sit-stand-tables comprising:

a longitudinal member;

two height-adjustable legs attached to the longitudinal member, each height-adjustable leg comprising:

at least two telescopic profiles consisting of an outer and an inner profile; and a driving mechanism;

a motor unit mounted in the longitudinal member, the motor unit comprising an electric motor and a gear; and a drive shaft connected to the motor unit, the drive shaft running through the longitudinal member to at least one of the height-adjustable legs, wherein the frame further comprises at least one spline coupling comprising:

a worm gear located at an end of the drive shaft opposite the motor unit, the worm gear located within a recess on the longitudinal member; and a pin located on an end of one of the height-adjustable legs, wherein the pin is configured to fit into the recess and engage with the worm gear when the height-adjustable leg is attached to the longitudinal member.

* * * * *